US008375828B2

(12) United States Patent
Chen

(10) Patent No.: US 8,375,828 B2
(45) Date of Patent: Feb. 19, 2013

(54) POWER DRIVEN RATCHET WRENCH

(75) Inventor: Hsien Chung Chen, Taichung Hsien (TW)

(73) Assignee: Hyphone Machine Industry Co. Ltd., Taichung Hsien (TW)

( * ) Notice: Subject to any disclaimer, the term of this patent is extended or adjusted under 35 U.S.C. 154(b) by 395 days.

(21) Appl. No.: 12/751,948

(22) Filed: Mar. 31, 2010

(65) Prior Publication Data

US 2010/0313715 A1 Dec. 16, 2010

(30) Foreign Application Priority Data

Jun. 12, 2009 (TW) ..... 98210562 U

(51) Int. Cl.
*B25B 21/00* (2006.01)
*B25B 13/46* (2006.01)

(52) U.S. Cl. ..... 81/57.39; 81/63

(58) Field of Classification Search ..... 81/57.39, 81/63, 63.2, 57.13, 57.29
See application file for complete search history.

(56) References Cited

U.S. PATENT DOCUMENTS 5,584,220 A * 12/1996 Darrah et al. ..... 81/57.29
6,138,532 A * 10/2000 McCann ..... 81/DIG. 5
6,640,669 B2 * 11/2003 Izumisawa ..... 81/57.39
2006/0219060 A1 * 10/2006 Miner ..... 81/57.39

* cited by examiner

*Primary Examiner* — Hadi Shakeri

(57) ABSTRACT

A power driven ratchet wrench includes a handle, a working portion and a switch portion. The working portion includes a yoke, a ratchet head and a socket. The yoke is disposed on the handle and defines a receiving space therein, and it has a first through hole. The ratchet head is coupled with a transmission element and has a third through hole corresponding to the first through hole. The ratchet head is swayable about an axis of the socket. The switch portion includes a switching button and an engaging unit. The engaging unit stops the socket from relatively rotating in a first direction as the switching button locates at a first switch position. The engaging unit stops the socket from relatively rotating in a second direction as the switching button locates at a second switch position.

8 Claims, 9 Drawing Sheets

POWER DRIVEN RATCHET WRENCH

BACKGROUND OF THE INVENTION

1. Field of the Invention

The present invention relates to a wrench, and more particularly to a power driven ratchet wrench.

2. Description of the Prior Art

A power driven ratchet wrench is invented for the user to stroke the workpiece with the least effort.

U.S. Pat. No. 5,448,930 discloses a powered tool socket, the socket is powered driven by a drive wheel so as to rapidly drive a workpiece. However, the drive wheel is only workable in one rotary direction.

U.S. Pat. No. 4,722,252 discloses a power driven wrench that can drive the workpiece in both rotary directions. Specifically, U.S. Pat. No. 4,722,252 provides a switching lever extending from two sides of the ratchet head for the user to manually switch the position of the lever, so as to adjust the working direction of the ratchet wrench. Since the lever extends out of the ratchet head, it is dangerous when the ratchet head is powered driven to sway rapidly along with the switching lever.

The present invention is, therefore, arisen to resolve or at least mitigate the above-mentioned disadvantages.

SUMMARY OF THE INVENTION

The main object of the present invention is to provide a power driven ratchet wrench with its switching button staying immobile while the ratchet head is driven.

To achieve the above and other objects, a power driven ratchet wrench of the present invention includes a handle, a working portion and a switch portion. The handle includes a transmission element and a driven element which is adapted to drive the transmission element. The working portion includes a yoke, a ratchet head and a socket. The yoke is disposed on the handle and is close to the transmission element. The yoke defines a receiving space therein, and it has a first through hole vertically communicated with the receiving space. The ratchet head is coupled with the transmission element and has a third through hole corresponding to the first through hole. The ratchet head is drivable by the transmission element to sway about an axis of the socket, in which the socket is disposed in the first through hole and the third through hole. The socket has an inner periphery and an outer periphery. The inner periphery defines a non-circular bore, and the outer periphery is formed with a plurality of teeth. The switch portion is disposed on the working portion, and it includes a switching button and an engaging unit. The switching button is adapted to couple with the engaging unit and is movable between a first switch position and a second switch position. The engaging unit stops the socket from relatively rotating in a first direction as the switching button locates at the first switch position. The engaging unit stops the socket from relatively rotating in a second direction as the switching button locates at the second switch position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
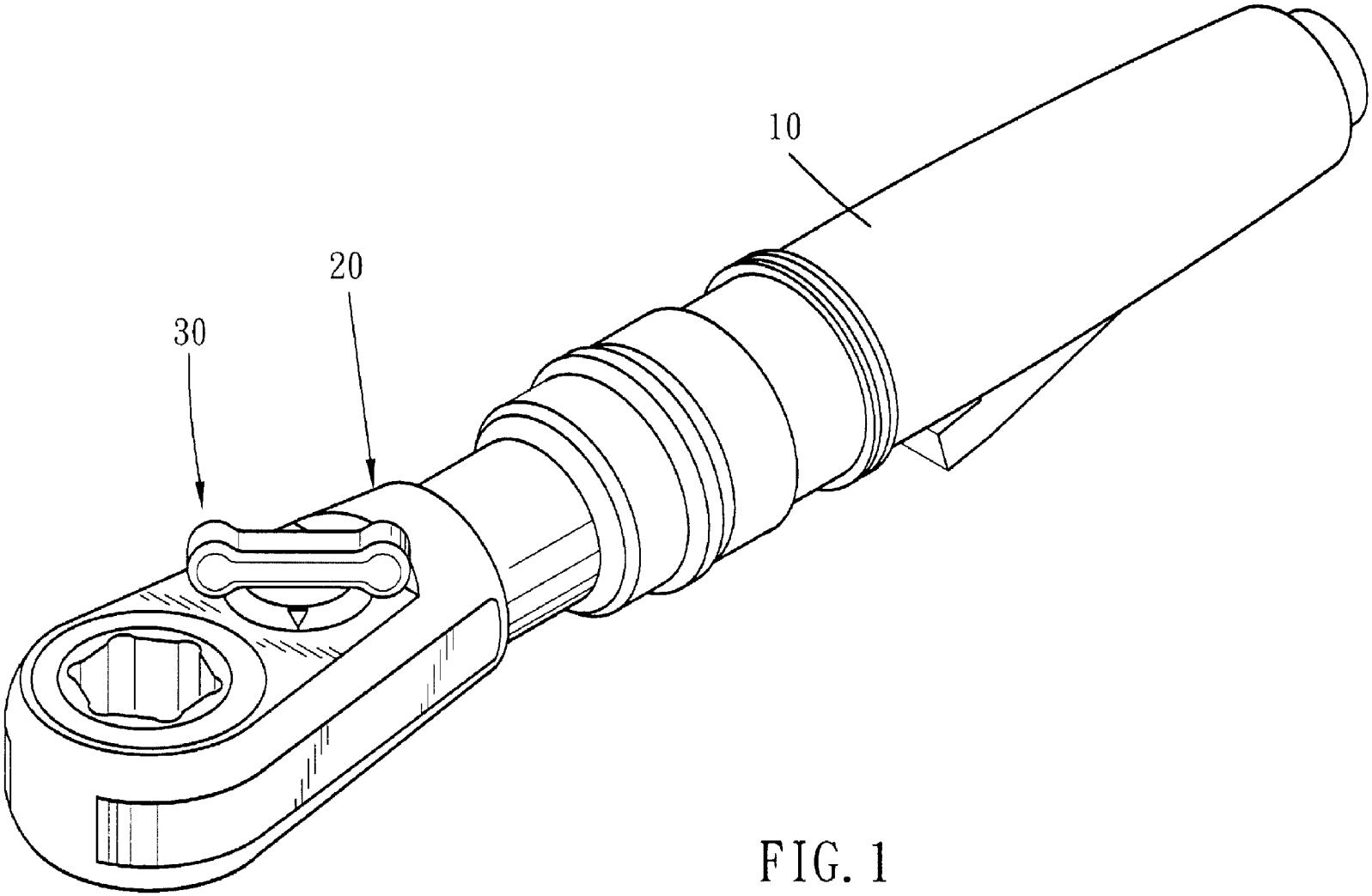
FIG. 1 is a perspective drawing of the present invention.
Figure 2:
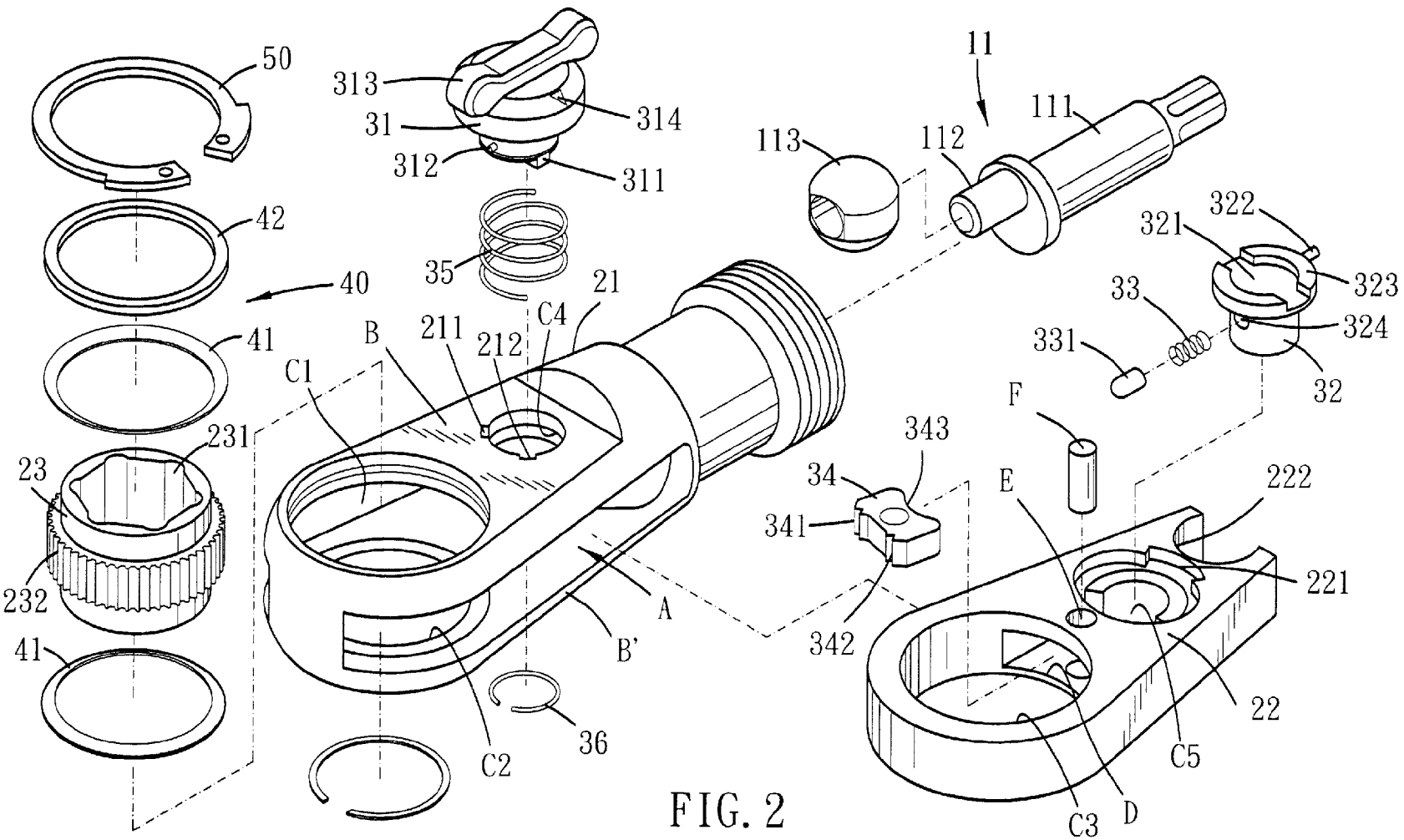
FIG. 2 is a partial breakdown drawing of the present invention.
Figure 3:
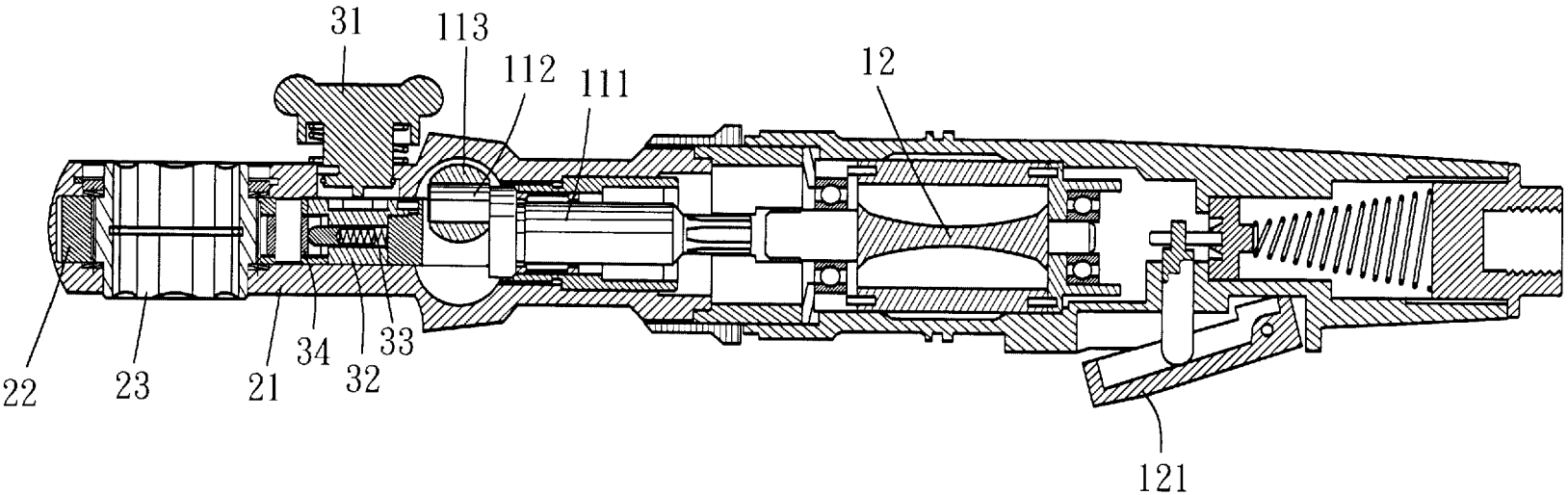
FIG. 3 is a profile of the present invention.

Please refer to FIG. 1 to FIG. 3. A power driven ratchet wrench of the present invention includes a handle 10, a working portion 20 and a switch portion 30. The handle includes a transmission element 11 and a driving element 12 which is coupled with and adapted to drive the transmission element 11. The transmission element 11 includes an axle 111 and a ball-shaped sleeve 113. The axle 111 is coupled with the driving element 12 and has a protrusion 112 offset from its axis, and the sleeve 113 engages with the protrusion 112. The driving element 12 includes a turbine blade that can transmit the kinetic energy of gas into the energy to rotate the axle 11. The driving element 12 may be a powered motor instead of the turbine. The driving element 12 further includes a lever 121 for manual switch of the driving element 12.

The working portion 20 is disposed on the handle 10 and is close to the transmission element 11. The working portion 20 includes a yoke 21, a ratchet head 22 and a socket 23. The yoke 21 defines a receiving space A therein. More specifically, the yoke 21 has a first plate B and a second plate B' which define the receiving space A therebetween. The first plate B is formed with a first through hole C1, and the second plate B' is formed with a second through hole C2 corresponding to the first through hole C1. Both the first and second through holes C1 and C2 vertically communicate with the receiving space A. The first plate B is further formed with a fourth through hole C4. A first slot 211 and a second slot 212 are formed on the first plate B to communicate with the fourth through hole C4.

The ratchet head 22 is disposed in the receiving space A, and the ratchet head 22 is formed with a third through hole C3, which is communicated with the first and second through holes C1 and C2, and a stepped fifth trough hole C5, which corresponds to the fourth through hole C4 but does not penetrate the ratchet head 22. An arc positioning groove 221 is defined on the ratchet head 22 and is communicated with the fifth through hole C5. The arc positioning groove 221 has a first end surface 2211 and a second end surface 2212. A communicating space D is defined by a first side wall D1 and a second side wall D2 in the ratchet head 22 to communicate the third through hole C3 with the fifth through hole C5. The ratchet head 22 is further formed with a vertical bore E communicated with the communicating space D. A rear end of the ratchet head 22 is further formed with a slot 222 to mate with the ball-shaped sleeve 113. As such, the rear end of the ratchet head as well as the sleeve 113 can be driven by the protrusion 112 to sway laterally within the receiving space A as the axle 111 rotates.

The socket 23 is rotatably disposed in the first, second and third through holes C1, C2 and C3. A skid-proof element 40 and a retaining collar 50 are disposed between the socket 23 and the yoke 21, in which the skid-proof element 40 includes a gasket 41 and a skid-proof collar 42. As such, the socket 23 may not rotate in the through holes spontaneously. The retaining collar 50 is detachably disposed between the skid-proof element 40 and the yoke 21 to stop the socket 23 from slip out of the through holes. Note that the socket 23 and the skid-proof element 40 are both replaceable to correspond to workpieces with different sizes. The socket 23 has an inner periphery and an outer periphery. The inner periphery defines a non-circular bore 231, e.g. a hexagonal bore, to directly engage with a workpiece. The socket 23 may also indirectly engage with a workpiece via an adapter. The outer periphery is annularly formed with a plurality of teeth 232.

The switch portion 30 is disposed on the working portion 20, wherein the switch portion 30 includes a switching button 31, an engaging unit, a resilient unit 35 and a retaining collar 36.

The switching button 31 is disposed in the fourth through hole C4. The retaining collar 36 retains the switching button 31 in the through hole C4. The switching button 31 has a top surface and a bottom surface. The top surface is formed with a grip portion 313 extending out of the fourth through hole C4. The bottom surface is formed with a wedge 311, which is preferably perpendicular to the orientation of the grip portion 313. The periphery of the switching button is formed with a positioning protrusion 312 which is selectively received in the first or second slot 211, 212 as the switching button 31 locates at a first switch position or a second switch position. For indication purposes, a direction indicator 314, such as an arrow mark, can be formed on the switch button 31, e.g. on the grip portion or the top surface.

The engaging unit includes a switching base 32, a resilient member 33 and an engaging shank 34. The switching base 32 is disposed in the fifth through hole C5, and the switching base 32 is formed with a concave slot 321 defined by two opposite arc walls 323 formed on the switching base 32. The concave slot 321 is selectively engaged with the wedge 311, and the slot 321 is preferably 1.2 times wider than the wedge 311 so that the wedge 311 can be received in the slot 321 no matter the switching button 31 locates at the first or second switch position. The resilient unit 35 is adapted to push the switching button 31 upward, so that the wedge 311 is disengaged from the concave slot 321 in a natural state (i.e. spontaneously). The switching base 32 has a tail pin 322 extending rearward, in which the tail pin 322 is received in the arc positioning groove 221 and is selectively stopped by one of the end surfaces D1 and D2 as the switching base 32 rotates in the fifth through hole C5. The switching base 32 may be further formed with a bore to receive part of the resilient member 33. A bullet-shaped pushing member 331 may be disposed between the resilient member 33 and the engaging shank 34. The engaging shank 34 is formed with a first biting portion 341 and a second biting portion 342, and a pin F is disposed in the vertical bore E and inserts into the engaging shank 34 so that the engaging shank 34 is swayable about the pin F in the communicating space D. The engaging shank 34 further has an arc surface 343 formed away from the socket 23 for the pushing member 331 (or the resilient member 33 provided that there is no pushing member 331) to abut thereagainst. As such, one of the biting portions 341 and 342 is more protrusive than the other to engage with the teeth 232 of the socket 23.

Figure 4:
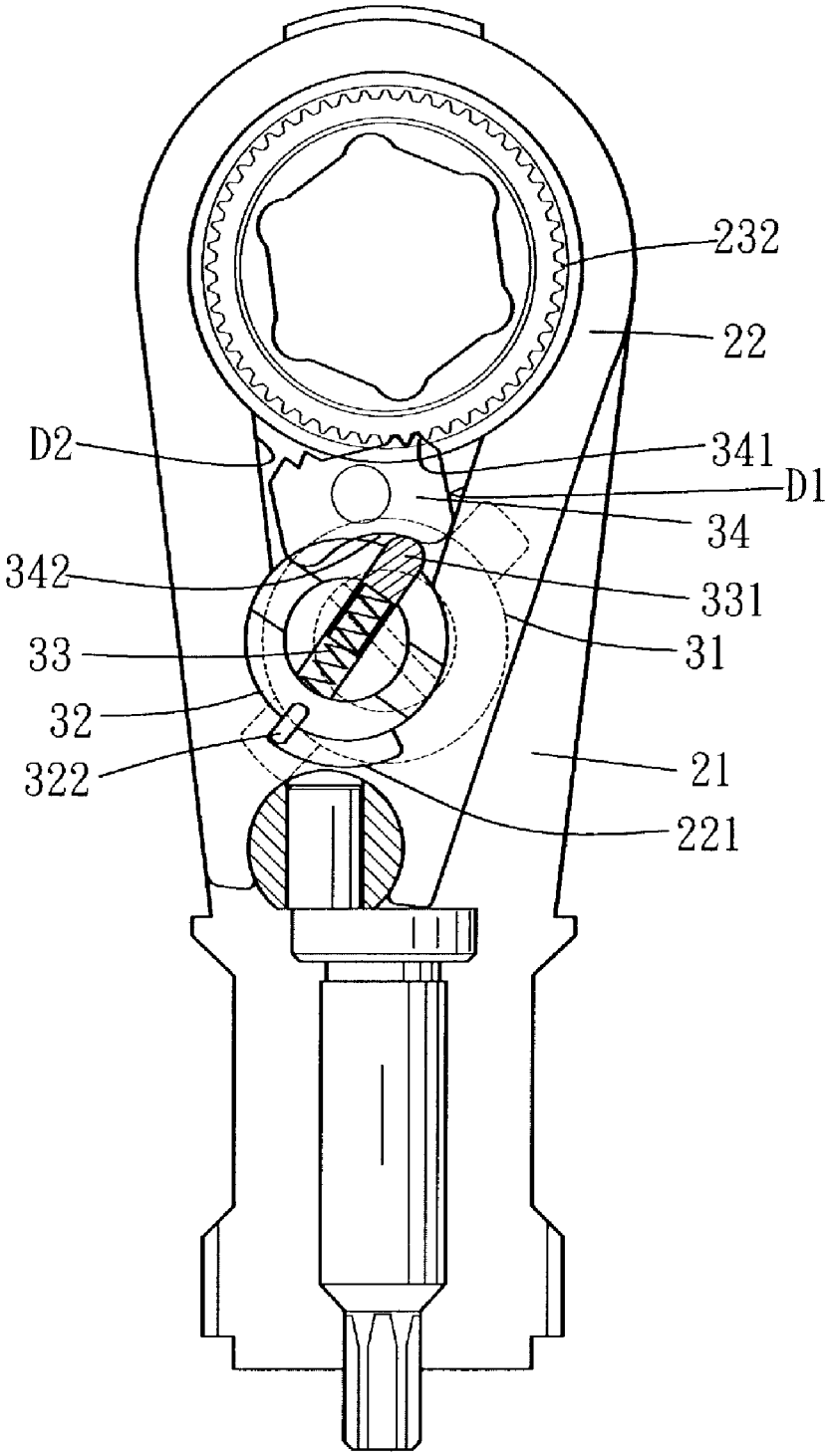
FIG. 4 is a drawing showing a working state of the present invention as the switching button locates at the first switch position.
Figure 5:
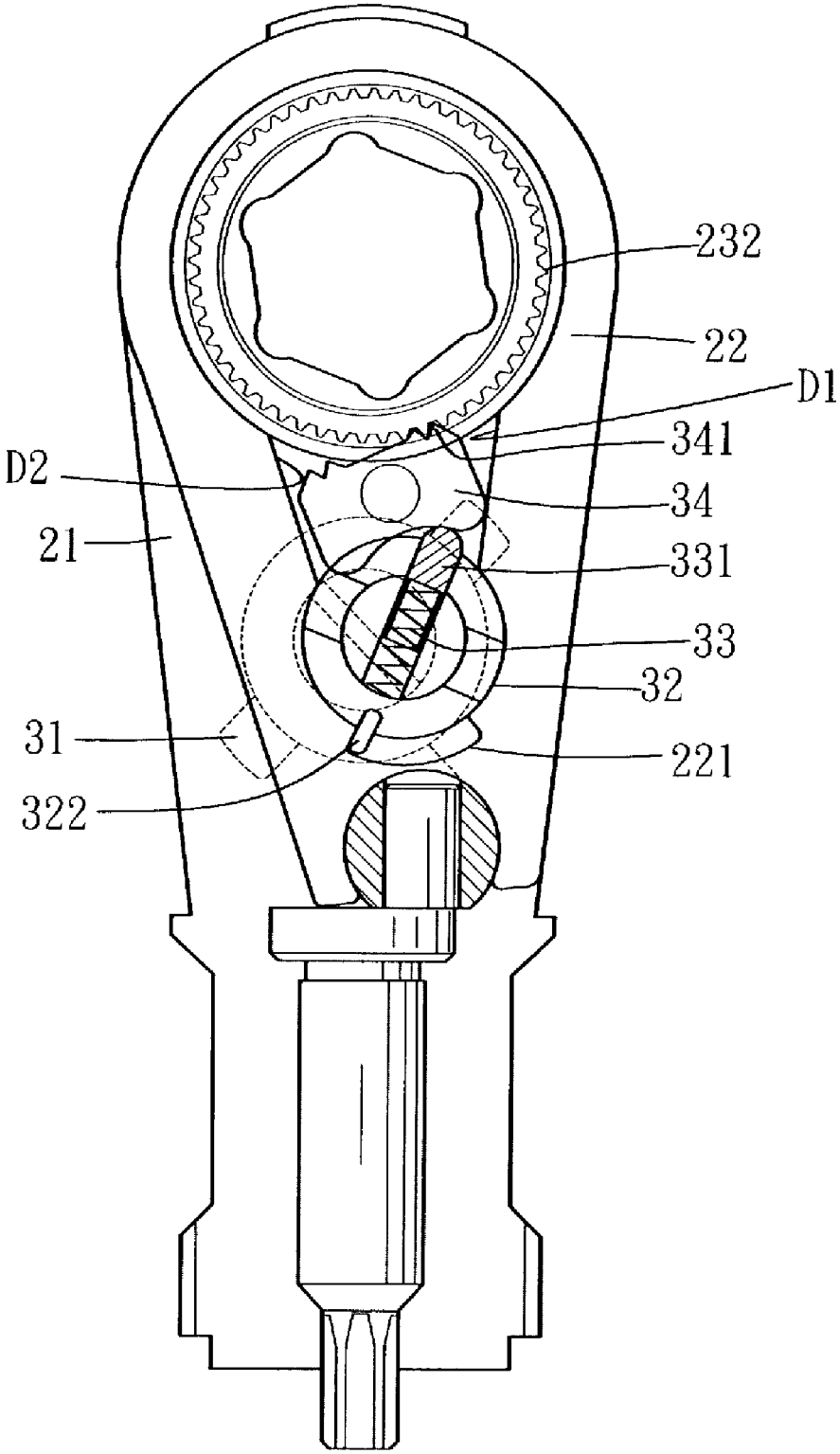
FIG. 5 is a drawing showing another working state of the present invention as the switching button locates at the first switch position.
Figure 8:
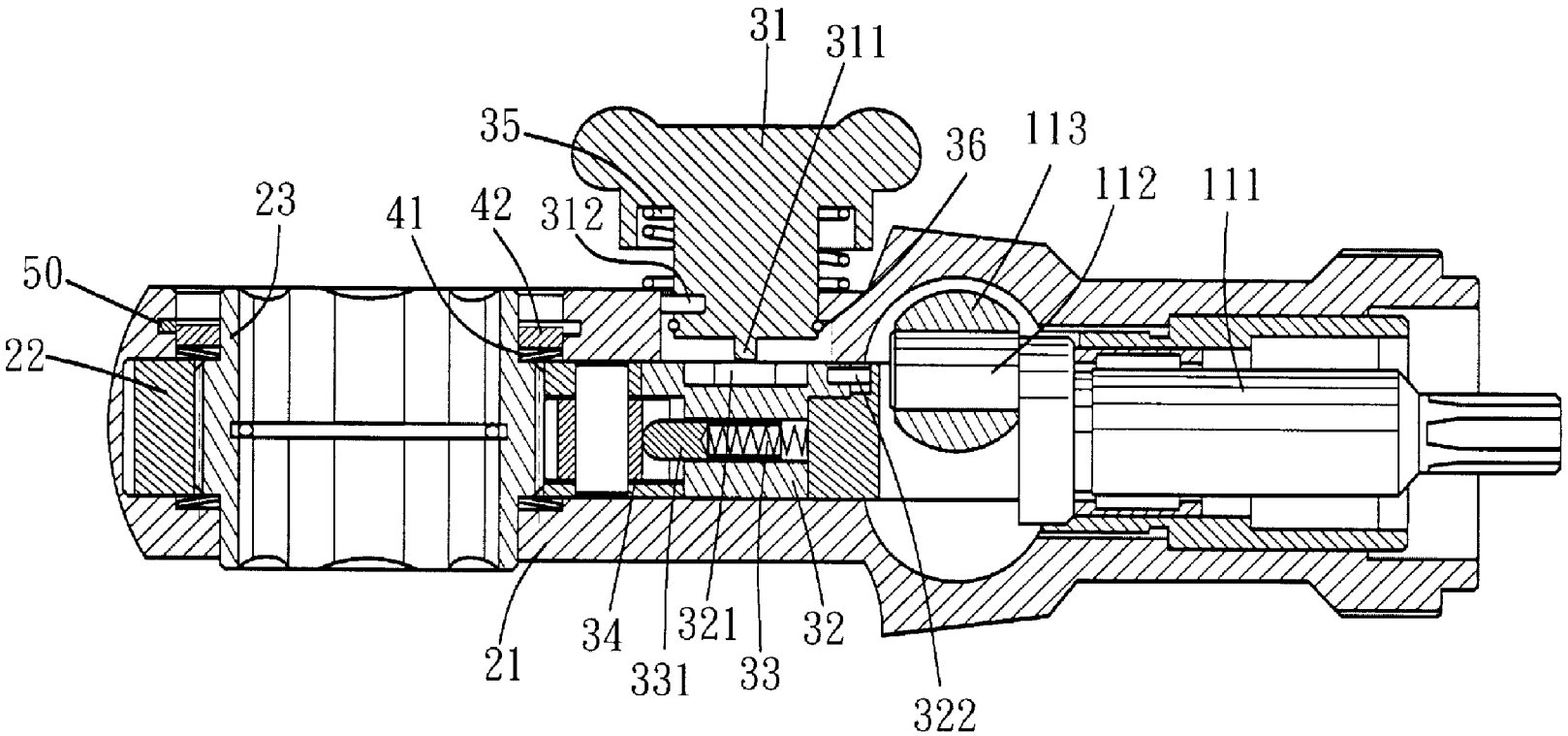
FIG. 8 is a profile of the present invention.
Figure 9:
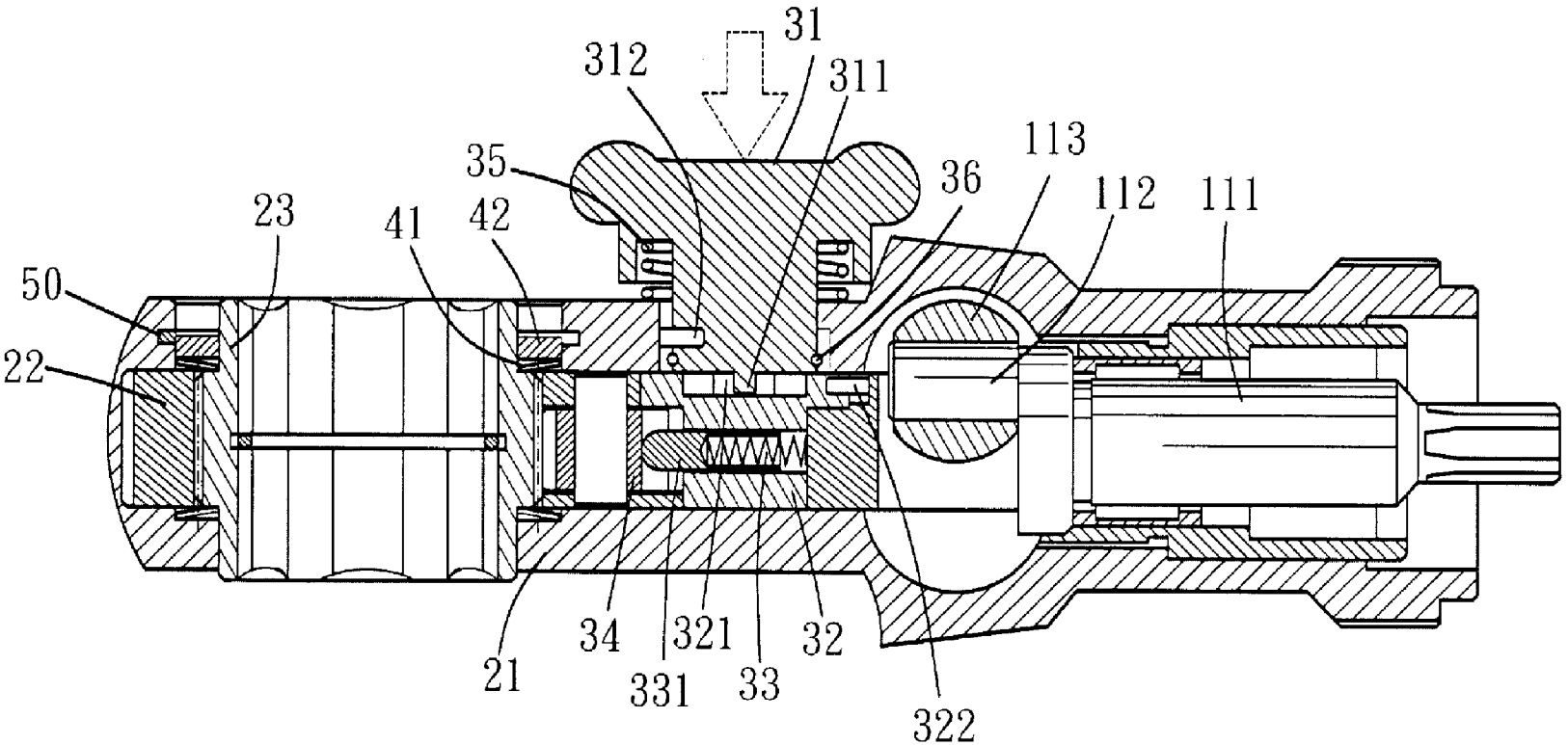
FIG. 9 is a profile of the present invention as the switching button is pressed downward.

Please refer to FIG. 8. The switching button 31 is pushed upward by the resilient unit 35 so that the wedge 311 is disengaged from the slot 321. As shown in FIG. 9, the switching button 31 can be manually pressed down for the wedge 311 to engage with the slot 321. Then, the switching button 31 and the switching base 32 can be manually turned to the first switch position (as shown in FIG. 4 and FIG. 5). Thereafter, the pressure upon the switching button 31 releases and the switching button 31 moves upward by the strength of the resilient unit 35, disengaging the wedge 311 from the slot 321 again. Since the switching base 32 has rotated for some angles, the engaging shank 34 is pushed by the pushing member 331 so that the first biting portion 341 bites the teeth 232 of the socket 23. At this moment, the engaging shank 34 abuts against the first side wall D1 of the communicating space D, thus the shank 34 cannot further rotate counterclockwise but clockwise. Accordingly, as the ratchet head 22 is driven to rotate counterclockwise about the axis of the socket 23, the first biting portion 341 will tightly engage with the teeth 232 of the socket 23. Thus the socket 23 can rotate counterclockwise as well. On the other hand, as the ratchet head 22 is driven to rotate clockwise, the shank 34 will rotate clockwise about the pin F, disengaging the first biting portion 341 from the teeth 232. As such, the wrench runs idle and the socket 23 is not turned.

Figure 6:
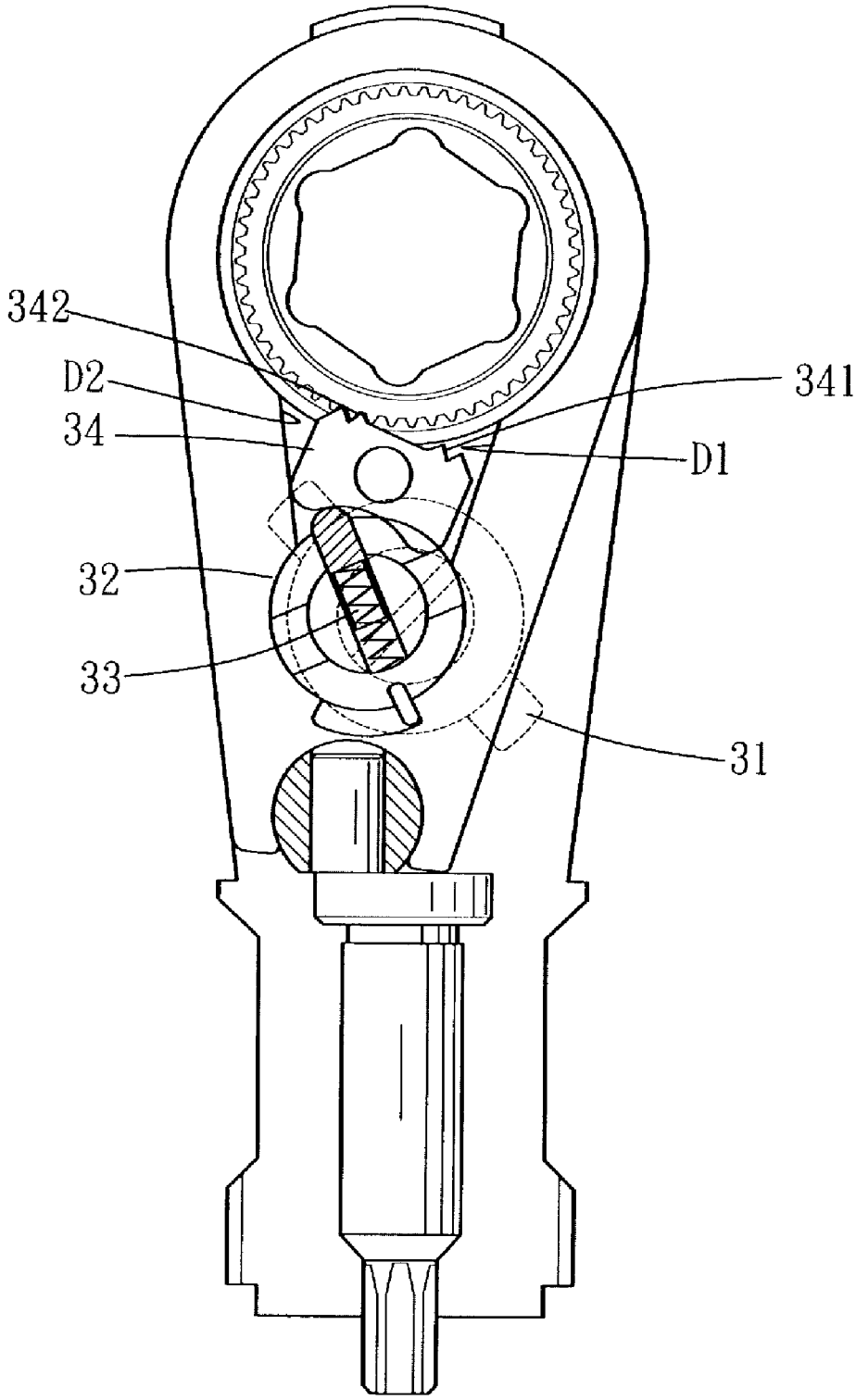
FIG. 6 is a drawing showing a working state of the present invention as the switching button locates at the second switch position.
Figure 7:
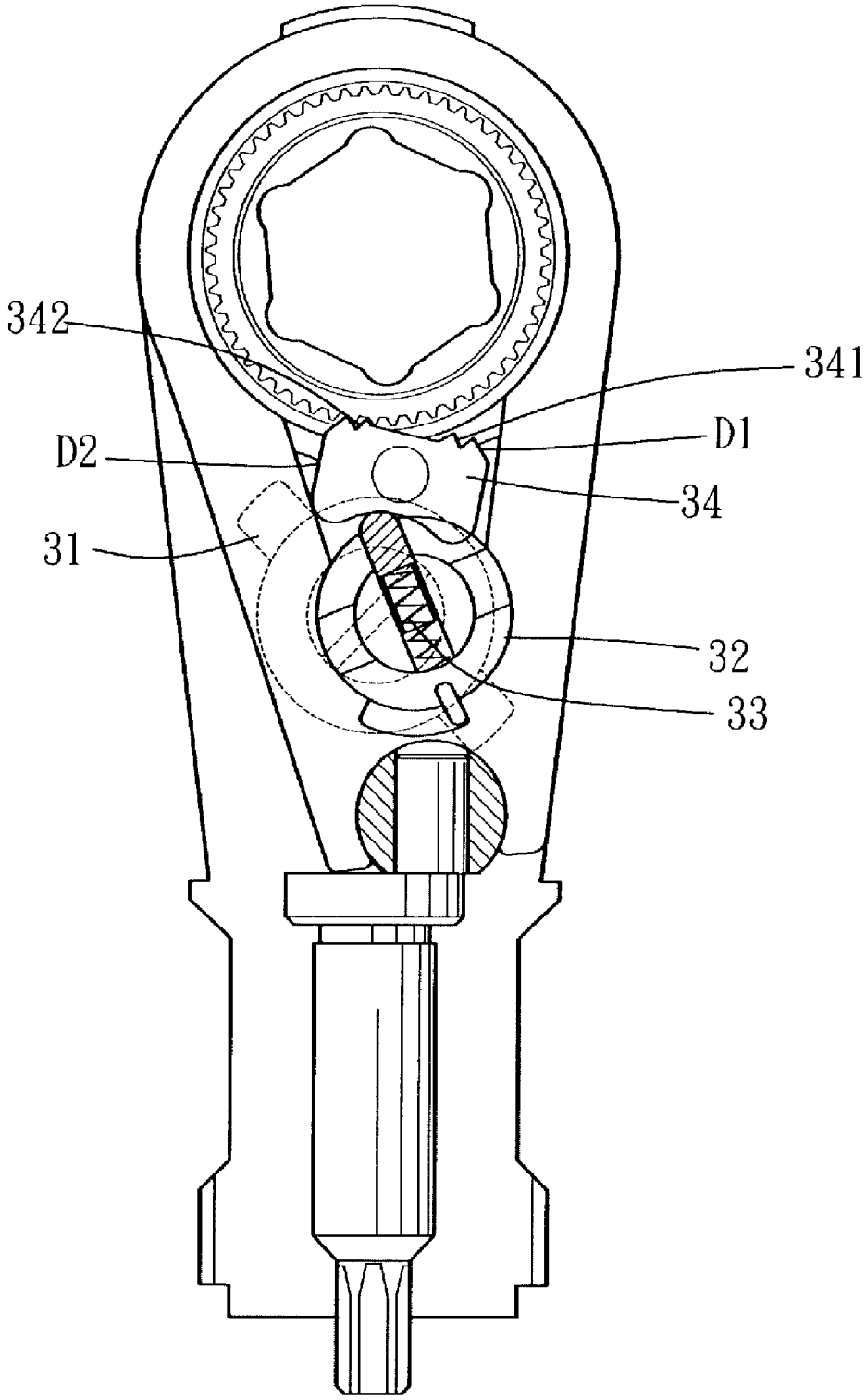
FIG. 7 is a drawing showing another working state of the present invention as the switching button locates at the second switch position.

As shown in FIG. 6 and FIG. 7, the switching button 31 and the switching base 32 are manually turned to the second switch position, thus the second biting portion 342 bites the teeth 232 of the socket 23. Since the engaging shank 34 abuts against the second side wall D2, the shank 34 cannot further rotate clockwise but counterclockwise. As such, when the ratchet head 22 rotates clockwise, the second biting portion 342 will tightly engage with the teeth 232 of the socket so that the socket 23 rotates clockwise as well. When the ratchet head 22, on the other hand, rotates counterclockwise, the shank 34 will rotate counterclockwise about the pin F, disengaging the second biting portion 342 from the teeth 232. Therefore, the wrench runs idle and the socket 23 is not turned.

In summarization, the switch portion of the present invention is designed to adjust the working direction of the socket. And because the switching button can disengage with the switching base spontaneously, the switching button stays immobile while the wrench is working. Therefore, it is rather safer to provide a power driven ratchet wrench with no parts protruding from the yoke and shaking rapidly while the wrench is working.

What is claimed is:

1. A power driven ratchet wrench, comprising:

a handle, comprising a transmission element and a driving element, the driving element being adapted to drive the transmission element;

a working portion, comprising a yoke, a ratchet head and a socket, the yoke being disposed on the handle and being close to the transmission element, the yoke defining a receiving space therein, the yoke having a first through hole vertically communicated with the receiving space, the ratchet head being coupled with the transmission element, the ratchet head having a third through hole corresponding to the first through hole, the ratchet head being drivable by the transmission element to sway about an axis of the socket, the socket being disposed in the first through hole and the third through hole, the socket having an inner periphery and an outer periphery, the inner periphery defining a non-circular bore, the outer periphery being formed with a plurality of teeth;

a switch portion, disposed on the working portion, the switch portion comprising a switching button and an engaging unit, the switching button being adapted to couple with the engaging unit, the switching button being movable between a first switch position and a second switch position, the engaging unit stopping the socket from relatively rotating in a first direction as the switching button locating at the first switch position, the engaging unit stopping the socket from relatively rotating in a second direction opposite to the first direction as the switching button locating at the second switch position, wherein the yoke has a first plate and a second plate which define the receiving space therebetween, the first plate is formed with the first through hole, the second plate is formed with a second through hole corresponding to the first through hole, at least one of the first plate and the second plate is further formed with a fourth through hole to receive the switching button, the transmission element comprises an axle and a ball-shaped sleeve, the axle has a protrusion offset from its axis, the sleeve engages with the protrusion, a first slot and a second slot are formed to communicate with the fourth through hole, the ratchet head is formed with the third through hole for the socket to receive therein, the ratchet head is further formed with a fifth through hole communicated with the fourth through hole, a communicating space is defined in the ratchet head to communicate the third through hole with the fifth through hole, the ratchet head is further formed with a vertical bore communicated with the communicating space, the engaging unit is disposed in the fifth through hole and the communicating space, wherein the engaging unit comprising a switching base, a resilient member and an engaging shank, the switching base is disposed in the fifth through hole, the resilient member abuts against the switching base and the engaging shank, the engaging shank is formed with a first biting portion and a second biting portion which face the shocked, the teeth of the socket are selectively engaged with one of the biting portions, wherein the switching button has a top surface and a bottom surface, the top surface is formed with a grip portion, the bottom surface is formed with a wedge, the switching base is formed with a concave slot to couple with the wedge.

2. The wrench of claim 1, wherein the concave slot is wider than the wedge.

3. The wrench of claim 1, wherein a pin is disposed in the vertical bore and inserts into the engaging shank, the engaging shank is swayable about the pin, the engaging shank having an arc surface away from the socket for the resilient member to abut thereagainst, the switching base has a tail pin extending rearward, an arc positioning groove is defined on the ratchet head and is communicated with the fifth through hole, the arc positioning groove has two end surfaces, the tail pin is received in the arc positioning groove, the tail pin is selectively stopped by one of the end surfaces as the switching base rotates in the fifth through hole.

4. The wrench of claim 3, wherein the switching button is formed with a positioning protrusion selectively received in the first or second slot as the switching button locates at the first switch position or the second switch position.

5. The wrench of claim 1, wherein a pushing member is disposed between the resilient member and the engaging shank, a pin is disposed in the vertical bore and inserts into the engaging shank, the engaging shank is swayable about the pin, the engaging shank having an arc surface away from the socket for the pushing member to abut thereagainst, the switching base has a tail pin extending rearward, an arc positioning groove is defined on the ratchet head and is communicated with the fifth through hole, the arc positioning groove has two end surfaces, the tail pin is received in the arc positioning groove, the tail pin is selectively stopped by one of the end surfaces as the switching base rotates in the fifth through hole.

6. The wrench of claim 5, wherein the switching button is formed with a positioning protrusion selectively received in the first or second slot as the switching button locates at the first switch position or the second switch position.

7. The wrench of claim 1, wherein the switch portion further comprises a resilient unit and a retaining collar, the resilient unit is adapted to push the switching button upward so that the wedge is disengaged from the concave slot in a natural state, the retaining collar is for retaining the switching button in the fourth through hole.

8. The wrench of claim 1, wherein a direction indicator is formed on the switch button.

* * * * *